US009256150B2

(12) United States Patent
Kurano et al.

(10) Patent No.: US 9,256,150 B2
(45) Date of Patent: Feb. 9, 2016

(54) TWO-COMPONENT DEVELOPER AND METHOD FOR PRODUCING TWO-COMPONENT DEVELOPER

(71) Applicant: KYOCERA Document Solutions Inc., Osaka (JP)

(72) Inventors: Yusuke Kurano, Osaka (JP); Hiroaki Moriyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/512,607

(22) Filed: Oct. 13, 2014

(65) Prior Publication Data

US 2015/0104744 A1 Apr. 16, 2015

(30) Foreign Application Priority Data

Oct. 16, 2013 (JP) ..... 2013-215470
Oct. 31, 2013 (JP) ..... 2013-226627

(51) Int. Cl.
*G03G 9/113* (2006.01)
*G03G 9/093* (2006.01)

(52) U.S. Cl.
CPC ..... *G03G 9/09314* (2013.01); *G03G 9/09392* (2013.01); *G03G 9/1131* (2013.01); *G03G 9/1134* (2013.01); *G03G 9/1135* (2013.01); *G03G 9/1139* (2013.01)

(58) Field of Classification Search
CPC .. G03G 9/1131; G03G 9/1134; G03G 9/1135
See application file for complete search history.

(56) References Cited

U.S. PATENT DOCUMENTS 7,521,163 B2 4/2009 Uemura et al.
2006/0121385 A1* 6/2006 Uemura ..... G03G 9/1075 430/111.32

FOREIGN PATENT DOCUMENTS

JP H04-333861 A 11/1992
JP 2006-163373 A 6/2006
JP 2009-098348 A 5/2009

* cited by examiner

*Primary Examiner* — Peter Vajda
(74) *Attorney, Agent, or Firm* — Studebaker & Brackett PC

(57) ABSTRACT

A two-component developer of the present disclosure contains a carrier and toner particles. The carrier includes a carrier core, a first layer coating a surface of the carrier core, and a second layer coating a surface of the first layer. The first layer contains a fluorine-based resin, and the second layer contains a polyamide-imide resin and/or a melamine resin. The toner particles each include a toner core containing a binder resin and a shell layer coating a surface of the toner core. The shell layer contains a thermosetting resin.

5 Claims, 3 Drawing Sheets

TWO-COMPONENT DEVELOPER AND METHOD FOR PRODUCING TWO-COMPONENT DEVELOPER

INCORPORATION BY REFERENCE

The present application claims priority under 35 U.S.C. §119 to Japanese Patent Application Nos. 2013-215470, filed Oct. 16, 2013 and 2013-226627, filed Oct. 31, 2013. The contents of these applications are incorporated herein by reference in their entirety.

BACKGROUND

The present disclosure relates to two-component developers containing toner particles and a carrier, and methods for producing two-component developers. A two-component developer containing toner particles and a carrier is used in electrophotographic image formation. As the carrier, there has been known a carrier including a carrier core and a mixed resin coating a surface of the carrier core.

There has been also known a carrier including a carrier core and a two-layer coat of an under layer and a surface layer formed on a surface of the carrier core.

SUMMARY

A two-component developer of the present disclosure contains a carrier and toner particles. The carrier includes a carrier core, a first layer coating a surface of the carrier core, and a second layer coating a surface of the first layer. The first layer contains a fluorine-based resin, and the second layer contains a polyamide-imide resin and/or a melamine resin. The toner particles each include a toner core containing a binder resin and a shell layer coating a surface of the toner core. The shell layer contains a thermosetting resin.

A method for producing a two-component developer of the present disclosure is to produce a two-component developer containing a carrier and toner particles. This production method includes: preparing the carrier; preparing the toner particles; and mixing the carrier and the toner particles. The toner particles each include a toner core containing a binder resin and a shell layer coating a surface of the toner core. The shell layer contains a thermosetting resin. The preparing the carrier includes: preparing carrier cores; applying a first layer formation liquid containing a fluorine-based resin to surfaces of the carrier cores; applying a second layer formation liquid containing a polyamide-imide resin and/or a melamine resin to the surfaces of the carrier cores subjected to the applying of the first layer formation liquid; and heat-treating the carrier cores subjected to the applying of the first layer formation liquid and the second layer formation liquid.

DETAILED DESCRIPTION

Hereinafter, an embodiment of the present disclosure will be described in detail. The present disclosure is in no way limited to the embodiment below, and various alterations may be made to practice the present disclosure within the scope of the objects of the present disclosure. It should be noted that some overlapping explanations may be omitted as appropriate. Such omission, however, is not intended to limit the gist of the disclosure.

A two-component developer of the present embodiment contains a carrier and toner particles. Hereinafter, the carrier, the toner particles, and the two-component developer will be described in detail in the noted order.

[Carrier]

Figure 1:
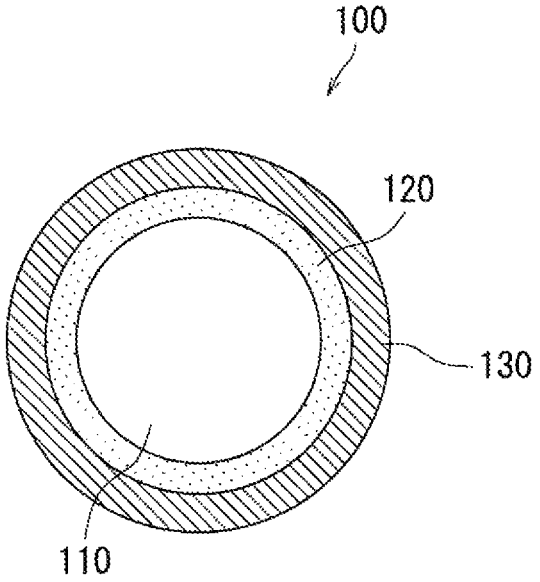
FIG. 1 is a diagram showing a form of a carrier to be contained in a two-component developer of an embodiment of the present disclosure.

Hereinafter, the carrier will be described with reference to FIG. 1. FIG. 1 is a diagram showing a carrier 100 contained in the two-component developer of the present embodiment. As shown in FIG. 1, the carrier 100 is represented by one of a plurality of particles each including a carrier core 110, a first layer 120 coating a surface of the carrier core 110, and a second layer 130 coating the first layer 120. The first layer 120 contains a fluorine-based resin, and the second layer 130 contains a polyamide-imide resin and/or a melamine resin.

The fluorine-based resin forming the first layer 120 has excellent chargeability, and therefore the carrier 100 can maintain appropriate chargeability. The polyamide-imide resin and/or the melamine resin forming the second layer 130 has excellent strength and hardness, and therefore can enhance the durability of the carrier 100 and reduce toner to be spent on the carrier.

The carrier core 110 may be coated with a single layer of a mixed resin of a fluorine-based resin and a polyamide-imide resin and/or a melamine resin rather than with the two layers of the first layer 120 and the second layer 130. In this case, the fluorine-based resin having relatively low hardness partly emerges on the surface of the carrier. Accordingly, only a carrier having poor durability can be obtained.

As the material of the carrier core 110, may be mentioned those known and usable for carriers of two-component developers. Examples thereof include metals such as ferrite, magnetite, iron, nickel, and cobalt; alloys or mixtures of the aforementioned metals and other metals such as copper, zinc, antimony, aluminum, lead, tin, bismuth, beryllium, manganese, magnesium, selenium, tungsten, zirconium, and vanadium; metal oxides such as ferrite, iron oxide, titanium oxide, and magnesium oxide; mixtures of the aforementioned metals or metal oxides and nitrides such as chromium nitride and vanadium nitride; mixtures of the aforementioned metals or metal oxides and carbides such as silicon carbide and tungsten carbide; and ferromagnetic ferrite. Preferably, the material of the carrier core is ferrite or magnetite because these materials are likely to provide a necessary magnetic property.

Preferably, the carrier core 110 has an average particle diameter of 30 μm or more and 100 μm or less. When the carrier core 110 has an average particle diameter of 30 μm or more and 100 μm or less, the two-component developer of the present embodiment containing the carrier 100 can achieve satisfactory developing properties. The average particle diameter can be measured by using a laser diffraction, light scattering-type particle size measuring device ("LA-700", manufactured by HORIBA, Ltd.)

Hereinafter, the first layer 120 will be described. In the present embodiment, as described above, the carrier 100 can have enhanced chargeability since the first layer 120 contains a fluorine-based resin.

Examples of the fluorine-based resin include tetrafluoroethylene-perfluoroalkylvinylether copolymer (PFA), tetrafluoroethylene-hexafluoropropylene copolymer (FEP), polytetrafluoroethylene (PTFE), polyvinylidene difluoride (PVDF), and polyvinyl fluoride (PVF). In order to sufficiently enhance the chargeability, the fluorine-based resin is preferably one or more resins selected from the group consisting of tetrafluoroethylene-perfluoroalkylvinylether copolymer, tetrafluoroethylene-hexafluoropropylene copolymer, and polytetrafluoroethylene.

Preferably, the amount of the fluorine-based resin to be used for forming the first layer 120 of the carrier 100 is 1 part by mass or more and 15 parts by mass or less with respect to 100 parts by mass of the carrier core 110. Containing 1 part by mass or more of the fluorine-based resin, the carrier 100 can be prevented from being reduced in chargeability. Accordingly, fogging (toner particles adhering to a non-exposed portion) can be reduced. Furthermore, it is possible to reduce the possibility that only toner particles excessively depart from the developer during the development. Containing 15 parts by mass or less of the fluorine-based resin, the carrier 100 can have suitably low chargeability, prevented from having too high chargeability. Accordingly, decrease in image density due to impaired developing properties can be prevented.

Preferably, the first layer 120 has a thickness of 100 nm or more and 2000 nm or less in order to enhance the chargeability.

Hereinafter, the second layer 130 will be described. The second layer 130 contains a polyamide-imide resin and/or a melamine resin. That is, a polyamide-imide resin or a melamine resin may be used independently, or a resin obtained by mixing a polyamide-imide resin and a melamine resin may be used. The polyamide-imide resin and the melamine resin have higher hardness, higher abrasion resistance, and higher heat resistance than other thermosetting resins (e.g., phenolic resin). Having a coat of the second layer 130, therefore, the carrier 100 has excellent durability. Furthermore, the melamine resin is highly cationic. When a melamine resin is used for the second layer 130, therefore, toner particles each having a cationic shell layer can be prevented from being attached to (spent on) the carrier 100.

The polyamide-imide resin can be produced by, for example, an isocyanate process or an amine process (e.g., acid chloride method, low-temperature solution polymerization, or room-temperature solution polymerization). In particular, the isocyanate process is preferable because it gives a polyamide-imide resin in the form of a solution. The polyamide-imide resin-containing solution is soluble in an organic solvent, and therefore shows excellent handling characteristics in the formation of the second layer 130. Specific examples of the isocyanate process include a method by mixing a polar solvent, trimellitic anhydride (TMA), and an isocyanate compound, and copolymerizing the substances under an appropriate condition (e.g., reaction temperature or reaction period). Examples of the polar solvent include N-methyl-2-pyrrolidone. Examples of the isocyanate compound include 4,4'-diphenylmethane diisocyanate.

Preferably, the amount of the polyamide-imide resin and/or the melamine resin to be used for the formation of the second layer 130 is 1 part by mass or more and 15 parts by mass or less with respect to 100 parts by mass of the carrier core 110. Containing 1 part by mass or more of a polyamide-imide resin and/or a melamine resin, the carrier 100 can have sufficiently enhanced strength and durability. Containing 15 parts by mass or less of the polyamide-imide resin and/or the melamine resin, the carrier 100 can sufficiently get an effect of the fluorine-based resin forming the first layer, and therefore can impart a necessary and sufficient amount of charges to the toner. Containing 15 parts by mass or less of the polyamide-imide resin, the carrier 100 can sufficiently get toner particle charging ability of the fluorine-based resin in the first layer, and therefore can suitably charge the toner. Containing 15 parts by mass or less of melamine resin, furthermore, the carrier 100 can be prevented from being too highly cationic. Accordingly, the toner particles and the carrier 100 are contained homogeneously in the two-component developer. When the second layer containing the polyamide-imide resin and/or the melamine resin has a too large thickness, the toner charging function of the fluorine-based resin in the first layer is impaired.

Preferably, the second layer 130 has a thickness of 100 nm or more and 2000 nm or less in order to achieve a satisfactory cationic property and/or satisfactory durability.

Figure 2:
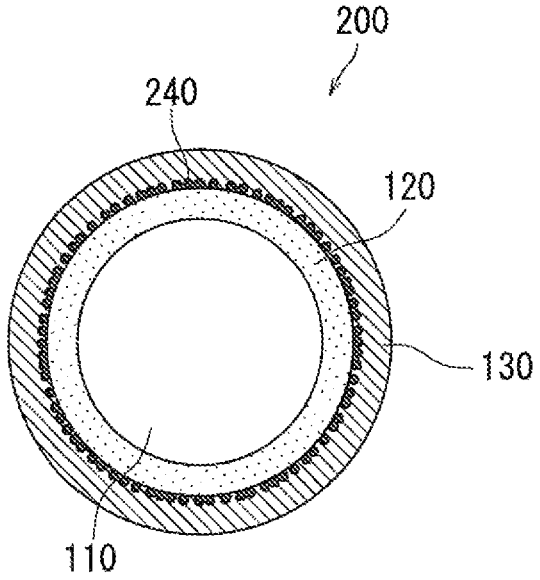
FIG. 2 is a diagram showing another form of the carrier contained in the two-component developer of the embodiment of the present disclosure.

The two-component developer of the present embodiment will be further described with reference to FIG. 2. FIG. 2 is a diagram showing another form of the carrier contained in the two-component developer of the present embodiment. As shown in FIG. 2, a carrier 200 is represented by one of a plurality of particles each including the carrier core 110, the first layer 120, the second layer 130, and an inorganic fine particle layer 240. The inorganic fine particle layer 240 contains inorganic fine particles and is formed between the first layer 120 and the second layer 130.

The inorganic fine particle layer 240 acts as a development electrode owing to the electrical conductivity of the inorganic fine particles. Accordingly, the carrier 200 can allow reduction of an edge effect (effect of increasing the density in an edge portion of an image and decreasing the density in a central portion of the image) and formation of high-quality images. Owing to the electrical conductivity of the inorganic fine particles, in addition, the inorganic fine particle layer 240 can prevent the toner particles from being excessively charged. In general, the image density tends to decrease when the image is continuously printed on a recording medium at a low coverage rate. However, the inorganic fine particle layer 240 is formed to give a carrier capable of preventing the decrease in the image density, which occurs in continuous printing at a low coverage rate. The fluorine-based resin generally has insufficient compatibility (miscibility) with another resin, and therefore the second layer 130 may not be formed uniformly on the surface of the first layer 120. However, when the inorganic fine particle layer 240 is formed between the first layer 120 and the second layer 130, the polyamide-imide resin and/or the melamine resin favorably diffuse on the surface of the first layer 120 using the inorganic fine particles as a base. Consequently, the second layer 130 can be formed uniformly.

Examples of the inorganic fine particles contained in the inorganic fine particle layer 240 include magnetite fine particles, titanium oxide fine particles, silica fine particles, and alumina fine particles. Preferably, the inorganic fine particles are magnetite fine particles as having high electrical conductivity.

The inorganic fine particles contained in the inorganic fine particle layer 240 have an average primary particle diameter of preferably 1000 nm or less, more preferably 10 nm or more and 500 nm or less, and particularly preferably 50 nm or more and 300 nm or less. Having an average particle diameter of 1000 nm or less, the inorganic fine particles are prevented from shedding from the inorganic fine particle layer 240. Having an average particle diameter of 50 nm or more, the inorganic fine particles can show satisfactory electrical conductivity.

Preferably, the amount of the inorganic fine particles to be used for forming the inorganic fine particle layer 240 is 0.1% by mass or more and 10% by mass or less with respect to the amount of the carrier cores. Used in an amount of 0.1% by mass or more, the inorganic fine particles can reduce the edge effect or excessive charging of toner particles originating in the carrier 200. Consequently, high-quality images can be formed. Used in an amount of 10% by mass or less, the inorganic fine particles can be prevented from shedding. Consequently, the inorganic fine particle layer 240 can be formed uniformly.

Preferably, the inorganic fine particle layer 240 is formed such that the inorganic fine particles therein are spaced as shown in FIG. 2. In this case, the first layer and the second layer are not completely separated by the inorganic fine particle layer 240, and therefore kept in close contact. Accordingly, the second layer adheres to the first layer well to be prevented from shedding.

[Toner Particles]

Figure 3:
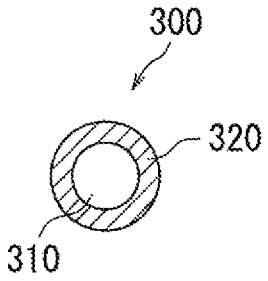
FIG. 3 is a diagram showing a toner particle contained in the two-component developer of the embodiment of the present disclosure.

The toner particles will be described with reference to FIG. 3. FIG. 3 is a diagram showing a toner particle 300 representing a plurality of toner particles. The toner particle 300 is mixed with the carrier 100 or with the carrier 200, and contained in a two-component developer. The toner particle 300 includes a toner core 310 and a shell layer 320.

Hereinafter, components for forming the toner core 310 will be described. The toner core 310 contains an anionic binder resin as an essential component. Specific examples of the binder resin include thermoplastic resins (e.g., styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, or styrene-butadiene-based resins). Preferably, the binder resin is a styrene-acrylic-based resin or a polyester resin in order to improve the dispersibility of a colorant in the toner particle 300, the chargeability of the toner, and the fixability of the toner to a recording medium.

The binder resin is a resin having, as a functional group, an ester group, a hydroxyl group, a carboxyl group, an amino group, an ether group, an acid group, or a methyl group, for example. Preferably, the binder resin is a resin having a functional group such as a hydroxyl group, a carboxyl group or an amino group in the molecule. More preferably, the binder resin is a resin having a hydroxyl group and/or a carboxyl group in the molecule. This is because such a functional group reacts with and chemically binds to a thermosetting component (e.g., methylolmelamine) of the resin forming the shell layer. As a result, the shell layer 320 and the toner core 310 strongly bind to each other in the toner particle 300 including the toner core 310 containing a binder resin having such a functional group.

A zeta-potential of a negative polarity as measured in an aqueous medium adjusted to pH4 is an indication of the toner core 310 being anionic. Preferably, the toner core 310 has a zeta-potential of −10 mV or lower in order to be favorably anionic. Another indication of the toner core 310 being anionic is a magnitude of its tribocharge value with a standard carrier of −10 μC/g or smaller.

Preferably, the binder resin has a glass transition point Tg equal to or lower than the cure onset temperature of the thermosetting resin contained in the shell layer 320 in order to enhance the low-temperature fixability of the toner. The binder resin having a glass transition point Tg equal to or lower than the cure onset temperature of the thermosetting resin provides the toner showing sufficient fixability even in high speed fixing.

The glass transition point Tg of the binder resin can be determined from a changing point of the specific heat of the binder resin measured using a differential scanning calorimeter (DSC). For example, the glass transition point Tg is determined by obtaining a heat absorption curve of the binder resin using a differential scanning calorimeter (e.g., "DSC-6200", manufactured by Seiko Instruments Inc.) as a measuring device. More specifically, a method is mentioned in which 10 mg of a measurement sample is placed in an aluminum pan, and the heat absorption curve of the binder resin is obtained with an empty aluminum pan as a reference in a measurement temperature range of 25° C. to 200° C. at a heating rate of 10° C./minute, and the glass transition point Tg is determined based on the heat absorption curve.

The binder resin has a softening point Tm of preferably 100° C. or lower, and more preferably 95° C. or lower. Having a softening point Tm of 100° C. or lower, the binder resin can ensure sufficient fixability even in high speed fixing. The softening point Tm of the binder resin can be adjusted by combining a plurality of binder resins having different softening points Tm, for example.

The softening point Tm of the binder resin can be measured using an elevated flow tester (e.g., "CFT-500D", manufactured by Shimadzu Corporation). Specifically, a measurement sample is set in the elevated type flow tester, and the sample having a volume of 1 $cm^3$ is allowed to melt-flow under a specified condition (die pore size: 1 mm, plunger load: 20 $kg/cm^2$, heating rate: 6° C./minute). Thus, an S-shaped curve (i.e., an S-shaped curve relating temperature (° C.) to stroke (mm)) is obtained, and the softening point Tm of the binder resin is read from the S-shaped curve.

Figure 4:
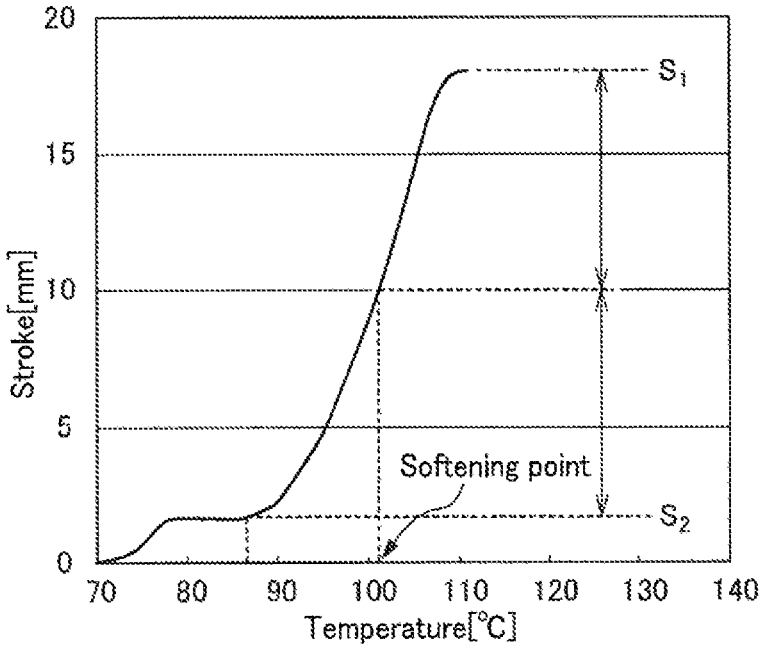
FIG. 4 is a graph representation illustrating how to read the softening point Tm of a binder resin.

How to read the softening point Tm of the binder resin will be explained with reference to FIG. 4. In FIG. 4, $S_1$ represents a maximum stroke value, and $S_2$ represents a baseline stroke value at a lower temperature side relative to the temperature corresponding to $S_1$. A temperature at which the stroke value in the S-shaped curve is $(S_1+S_2)/2$ is determined as the Tm of the measurement sample.

Referring back to FIG. 3, the description of the toner particle 300 will be continued. The toner core 310 may contain a colorant. A known pigment or a known dye may be used as the colorant depending on the color of the toner particle 300. The colorant may be a black colorant, and examples thereof include carbon black. A colorant whose color is adjusted to black using the later-described colorants such as yellow, magenta, and cyan colorants may be used as the black colorant.

When the toner particle 300 is a color toner particle, the toner core 310 may contain a yellow colorant, a magenta colorant, or a cyan colorant. Known pigments or known dyes may be used as such colorants.

The amount of the colorant to be used in the toner core 310 is preferably 1 part by mass or more and 20 parts by mass or less, and more preferably 3 parts by mass or more and 10 parts by mass or less with respect to 100 parts by mass of the binder resin.

The toner core 310 may contain a mold releasing agent in order to enhance the fixability and the offset resistance of the toner particle 300. Examples of the mold releasing agent include various waxes.

The amount of the mold releasing agent to be used in the toner core 310 is preferably 1 part by mass or more and 30 parts by mass or less, and more preferably 5 parts by mass or more and 20 parts by mass or less with respect to 100 parts by mass of the binder resin in order to enhance the fixability and the offset resistance of the toner particle 300.

The toner core 310 may contain a charge control agent in order to improve the charge level or the charge rising property of the toner particles and give the toner particles having excellent durability and stability. The charge rising property is an indication of whether or not the toner particles can be charged to a predetermined charge level within a short period of time. Since the toner core 310 is anionic (negatively chargeable), a negative charge control agent is used.

Next, the shell layer 320 will be described. The shell layer 320 is formed to coat the surface of the toner core 310. In order to enhance the strength and the hardness, and make the shell layer 320 sufficiently cationic, the resin for forming the shell layer 320 contains a thermosetting resin. In the present specification, the thermosetting resin has a unit obtained by introducing a methylene group (—$CH_2$—) derived from formaldehyde into a melamine monomer, for example.

Examples of the thermosetting resin include melamine resins, guanamine resins, sulfonamide resins, urea resins, glyoxal resins, aniline resins, and polyimide resins. Preferably, the thermosetting resin is a melamine resin because it is hard and sufficiently cationic. Furthermore, a melamine resin is preferable when a melamine resin is used for the second layer of the carrier 100 because the shell layer 320 can be given a cationic property comparable with that of the melamine resin forming the second layer of the carrier 100, and toner to be spent on the carrier can be effectively reduced.

A melamine resin is a polycondensate of melamine and formaldehyde. That is, a monomer to be used for forming a melamine resin is melamine. A urea resin is a polycondensate of urea and formaldehyde. That is, a monomer to be used for forming a urea resin is urea. A glyoxal resin is a polycondensate of formaldehyde and a reaction product of glyoxal and urea. That is, a monomer to be used for forming a glyoxal resin is a reaction product of glyoxal and urea. The melamine or the urea may be modified in a known manner. When the resin for forming the shell layer 320 contains a thermoplastic resin, the above-described thermosetting resin may contain a derivative methylolated with formaldehyde before the reaction with the thermoplastic resin.

Preferably, the shell layer 320 contains nitrogen atoms derived from melamine, urea, or the like. A material containing nitrogen atoms is likely to be positively charged, and therefore facilitates the toner particle 300 to be positively charged to a desired charge amount. Accordingly, the shell layer 320 preferably has a nitrogen atom content of 10% by mass or more. In addition, the shell layer 320 may contain a thermoplastic resin.

The shell layer 320 has a thickness of preferably 1 nm or more and 20 nm or less, and more preferably 1 nm or more and 10 nm or less. Having a thickness of 20 nm or less, the shell layer 320 is easily broken by heat and pressure applied when the toner particle 300 is fixed to a recording medium, for example. As a result, the binder resin and so forth contained in the toner core 310 quickly soften and melt. Thus, the toner particle 300 can be fixed to a recording medium at a lower temperature. Furthermore, the shell layer 320 has not too high chargeability, and therefore image formation can be appropriately performed. Having a thickness of 1 nm or more, the shell layer 320 has sufficient strength, and therefore can be prevented from being broken by impact or the like during transportation.

The thickness of the shell layer 320 can be measured using commercially available image analysis software (e.g., "Win ROOF", manufactured by Mitani Corporation).

The shell layer 320 may contain a charge control agent. The shell layer 320 can contain a positive charge control agent as being cationic (positively chargeable).

Preferably, the toner particle 300 has a volume average diameter of 4.0 μm or more and 10 μm or less so as to have enhanced fixability and handling characteristics. Preferably, for the same reason, the toner particle 300 has a number average diameter of 3.0 μm or more and 9.0 μm or less.

An external additive may be added to the surface of the shell layer 320 in order to enhance the fluidity and the handling characteristics of the toner particle 300. Examples of the external additive include particles of silica or metal oxides (e.g., alumina, titanium oxide, magnesium oxide, zinc oxide, strontium titanate, or barium titanate). Preferably, the external additive has a particle diameter of 0.01 μm or more and 1.0 μm or less in order to enhance the fluidity and the handling characteristics. In the present specification, the toner particle 300 yet to be treated with the external additive may be referred to as "toner mother particles".

The amount of the external additive is preferably 1 part by mass or more and 10 parts by mass or less, and more preferably 2 parts by mass or more and 5 parts by mass or less with respect to 100 parts by mass of the toner mother particles in order to enhance the fluidity and the handling characteristics.

[Two-Component Developer]

Figure 5:
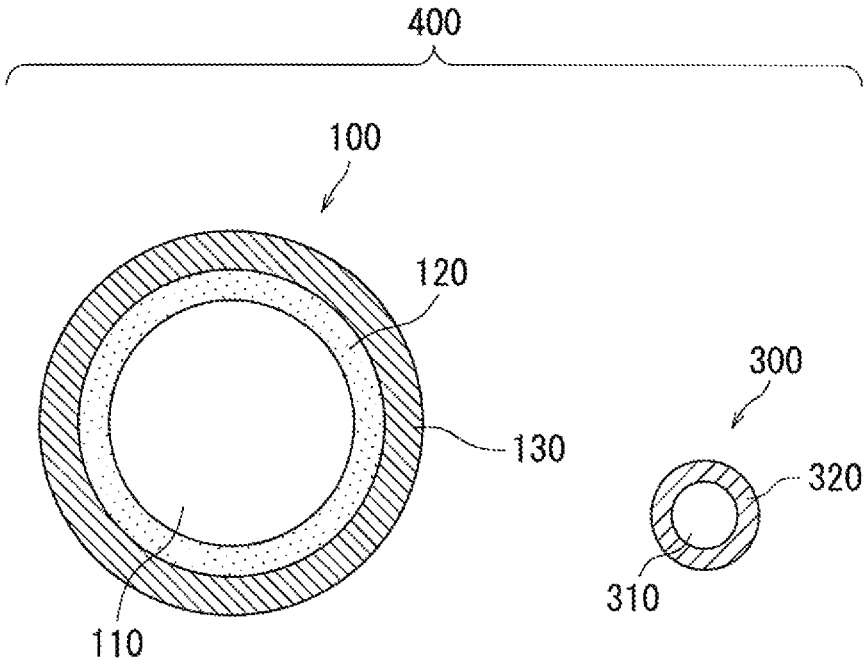
FIG. 5 is a diagram showing the two-component developer of the embodiment of the present disclosure.

A two-component developer of the present embodiment will be described with reference to FIG. 5. FIG. 5 is a diagram showing a two-component developer 400 of the present embodiment. As shown in FIG. 5, the two-component developer 400 of the present embodiment contains the carrier 100 and the toner particle 300.

The two-component developer 400 has a toner particle content of preferably 1 part by mass or more and 20 parts by mass or less, and more preferably 3 parts by mass or more and 15 parts by mass or less with respect to 100 parts by mass of the carrier 100. Having a toner particle content of 1 part by mass or more and 20 parts by mass or less, the two-component developer 400 can satisfactorily prevent toner scattering and achieve satisfactory chargeability.

A method for producing the two-component developer 400 includes: preparing a carrier 100 (carrier preparation); preparing the toner particle 300 (toner particle preparation); and mixing the carrier 100 and the toner particle 300 (mixing).

The carrier preparation will be described with reference to FIG. 1. In the carrier preparation, the carrier 100 is prepared. The carrier preparation includes: preparing carrier cores (carrier core preparation); applying a first layer formation liquid (first layer formation liquid application); applying a second layer formation liquid (second layer formation liquid application); and heat-treating (heat treatment).

In the carrier core preparation, the carrier core 110 is prepared. Specifically, a metal such as ferrite or magnetite is pulverized using a pulverizer such as a ball mill, and then baked to give the carrier core 110. The baking is performed using a burner baking furnace, a rotary type baking furnace, or an electric furnace, for example. The baking temperature in the carrier core preparation may be 900° C. or higher and 1200° C. or lower, for example. The baking period may be 1 hour or longer and 24 hours or shorter, for example. In the carrier core preparation, commercially available carrier cores may be used.

In the first layer formation liquid application, a first layer formation liquid is prepared, and the first layer formation liquid is applied to the surface of the carrier core 110. The first layer formation liquid contains a fluorine-based resin. Specifically, the first layer formation liquid is prepared by dispersing a fluorine-based resin in an appropriate solvent. The first layer 120 can be formed by heat-treating the first layer formation liquid containing a fluorine-based resin as described later to cure the fluorine-based resin on the surface of the carrier core 110. Examples of the solvent include methyl ethyl ketone and tetrahydrofuran. These solvents may be used as a mixture.

The first layer formation liquid can be applied to the surface of the carrier core 110 by a method by immersing the carrier core 110 in the first layer formation liquid, or a method by spraying the first layer formation liquid to the carrier core 110 while the carrier core 110 is being fluidized, for example.

In the second layer formation liquid application, a second layer formation liquid is prepared, and the second layer formation liquid is applied to the surface of the carrier core 110 subjected to the application of the first layer formation liquid. The second layer formation liquid contains a polyamide-imide resin and/or a melamine resin. Specifically, the second layer formation liquid is prepared by dispersing a polyamide-imide resin and/or a melamine resin in an appropriate solvent. The second layer 230 can be formed by heat-treating the second layer formation liquid containing a polyamide-imide resin and/or a melamine resin as described later to cure the polyamide-imide resin and/or the melamine resin on the surface of the carrier core 110 subjected to the application of the first layer formation liquid. Examples of the solvent include methyl ethyl ketone and tetrahydrofuran. These solvents may be used as a mixture.

The second layer formation liquid can be applied to the carrier core 110 subjected to the application of the first layer formation liquid by a method by immersing, in the second layer formation liquid, the carrier core 110 subjected to the application of the first layer formation liquid or a method by spraying the second layer formation liquid to the carrier core 110 subjected to the application of the first layer formation liquid while the carrier core 110 is being fluidized.

In the heat treatment, the carrier core 110 subjected to the application of the second layer formation liquid is heat-treated. As a result, the resins contained in the first layer formation liquid and the second layer formation liquid (i.e., the fluorine-based resin, and the polyamide-imide resin and/or the melamine resin) are cured, and thus the first layer and the second layer are formed. Specifically, the heat treatment can be performed by fluidizing the carrier core 110 subjected to the application of the first layer formation liquid and the second layer formation liquid in the noted order, and heat-treating the carrier core 110 being fluidized. The heat treatment temperature may be 200° C. or higher and 300° C. or lower, for example. The heat treatment period may be 30 minutes or longer and 90 minutes or shorter, for example.

When the inorganic fine particle layer 240 is formed between the first layer 120 and the second layer 130 as shown in FIG. 2, the formation of the inorganic fine particle layer 240 (inorganic fine particle layer formation) can be performed between the first layer formation liquid application and the second layer formation liquid application. Specifically, in the inorganic fine particle layer formation, the inorganic fine particle layer 240 can be formed by stirring the carrier core 110 subjected to the application of the first layer formation liquid and inorganic fine particles together using a known mixing agitator to attach the inorganic fine particles to the surface of the first layer formation liquid applied. Examples of the mixing agitator include a ball mill, a V-shaped mixer, or an FM mixer.

The toner particle preparation will be described with reference to FIG. 3. The preparing the toner particle 300 includes: preparing the toner core 310 containing a binder resin (toner core preparation); and coating the toner core 310 with the shell layer 320 (shell layer formation). The toner core 310 is coated with the shell layer 320 to give the toner particle 300 through the toner core preparation and the shell layer formation.

The toner core preparation can be performed by a method that allows optional components other than the binder resin (e.g., colorant, charge control agent, or mold releasing agent) to be well dispersed in the binder resin. Specific examples of the method include a melt-kneading method.

Hereinafter, the toner core preparation by the melt-kneading method will be described. The toner core preparation by the melt-kneading method includes melt-kneading, pulverization, and classification. In the melt-kneading, the binder resin and the other optional components are mixed together, and the resulting mixture is melt-kneaded to give a melt-kneaded product. In the pulverization, the melt-kneaded product is cooled and solidified as appropriate, and then pulverized by a known method to give a pulverized product. In the classification, the pulverized product is classified by a known method to give the toner core 310 having a desired particle diameter.

The shell layer formation in the toner particle preparation will be described with reference to FIG. 3. In the shell layer formation, the shell layer 320 is formed on the surface of the toner core 310 to give the toner particle 300 including the toner core 310 coated with the shell layer 320.

The shell layer 320 is formed by reacting melamine, urea, or a reaction product of glyoxal and urea, for example. Alternatively, the shell layer 320 is formed by reacting a precursor (methylolated product) produced through an addition reaction of formaldehyde and melamine, urea, or a reaction product of glyoxal and urea. Preferably, the shell layer 320 is formed in a solvent such as water. Use of a solvent such as water allows reduction of dissolution of the binder resin in the solvent and elution of a component such as a mold releasing agent contained in the toner core 310.

Preferably, in the shell layer formation, the shell layer 320 is formed by adding the materials of the shell layer 320 to a dispersion of the toner core 310 in an aqueous medium and dispersing the materials in the aqueous dispersion. Specific examples of the method for satisfactorily dispersing the toner core 310 in the aqueous medium include a method by mechanically dispersing the toner core 310 using an apparatus capable of intensely stirring the dispersion, and a method by adding a dispersant to the aqueous medium and dispersing the toner core 310 in the aqueous medium containing the dispersant. When the method involving the use of a dispersant is employed, the toner core 310 is homogeneously dispersed in the aqueous medium, and therefore it is easier to form the shell layer 320 uniformly.

Examples of the apparatus capable of intensively stirring the dispersion include HIVIS MIX (manufactured by PRIMIX Corporation). Examples of the dispersant include sodium polyacrylate.

When a dispersant is used in the shell layer formation, the amount of the dispersant is preferably 75 parts by mass or less with respect to 100 parts by mass of the toner core 310. When the amount of the dispersant is 75 parts by mass or less, the total organic carbon in the aqueous dispersion discharged as effluent after the shell layer formation can be reduced. In addition, decrease in the strength of bonding between the shell layer 320 and the toner core 310 due to the presence of the dispersant between the toner core 310 and the shell layer 320 can be prevented.

In the shell layer formation, preferably, the pH of the aqueous dispersion of the toner core 310 is adjusted to approximately pH 4. The dispersion is acidified to approximately pH 4 to accelerate a polycondensation reaction of the materials used for forming the shell layer 320. Preferably, the pH of the aqueous dispersion of the toner core 310 is adjusted before the formation of the shell layer 320.

After the pH of the aqueous dispersion of the toner core 310 is adjusted as needed, the materials for forming the shell layer 320 are dissolved in the aqueous dispersion of the toner core 310. Thereafter, the above-described methylolated product is reacted in the aqueous dispersion to form the shell layer 320 coating the surface of the toner core 310, for example.

The shell layer formation is performed preferably in a temperature range of 40° C. or higher and 95° C. or lower, and more preferably in a temperature range of 50° C. or higher and 80° C. or lower. In a temperature range of 40° C. or higher and 95° C. or lower, the formation of the shell layer 320 is favorably advanced.

When the shell layer 320 is formed in a temperature range of 40° C. or higher and 95° C. or lower with a binder resin including a resin having hydroxyl groups or carboxyl groups (e.g., polyester resin), the hydroxyl groups or the carboxyl groups emerging on the surface of the toner core 310 react with the methylol groups of the thermosetting resin. As a result of the reaction, covalent bonding is formed between the binder resin forming the toner core 310 and the resin forming the shell layer 320, causing the shell layer 320 to firmly adhere to the toner core 310.

After the formation of the shell layer 320 in the shell layer formation, the aqueous dispersion of the toner core 310 coated with the shell layer 320 is cooled to room temperature. Thus, a dispersion of the toner particle 300 (toner mother particles) can be obtained. Thereafter, washing, drying, and/or external additive addition is performed as needed, and then the toner particle 300 is collected from the dispersion of the toner particle 300.

The washing is to wash the toner particle 300 (toner mother particles) with water. Examples of suitable methods of the washing include a method by collecting the toner particle 300 in the form of wet cake from the aqueous dispersion of the toner particle 300 by solid-liquid separation and washing the wet cake with water; and a method by allowing the toner particle 300 in the dispersion of the toner particle 300 to settle, and then replacing the supernatant with water, and then dispersing again the toner particle 300 (toner mother particles) in water.

The drying is to dry the toner particle 300 (toner mother particles) collected or washed using a dryer (e.g., a spray dryer, a fluidized bed dryer, a vacuum freeze dryer, or a reduced pressure dryer), for example.

The external additive addition is to add an external additive to the surface of the toner particle 300 (toner mother particles). Suitable examples of the external additive addition include a method by mixing the toner mother particles and the external additive using a mixer (e.g., an FM mixer or a Nauta® mixer) under a condition adjusted so as to prevent the external additive from being completely buried in the surfaces of the toner mother particles.

The mixing in the production method of the present embodiment is to mix the carrier 100 and the toner particle 300 under an appropriate condition to obtain the above-described two-component developer of the present embodiment. A mixer such as a ball mill, a Nauta mixer, or a rocking mixer may be used for the mixing.

EXAMPLES

Hereinafter, the present disclosure will be described in more detail by way of examples. The present disclosure is in no way limited to the scope of the examples.

Example 1

Preparation of Toner Particles A

First, toner cores were prepared as follows. One hundred (100) parts by mass of a polyester resin ("XPE258", manufactured by Mitsui Chemicals, Inc.), 5 parts by mass of a polypropylene wax as a mold releasing agent ("660P", manufactured by Sanyo Chemical Industries, Ltd.), and 5 parts by mass of a carbon black as a colorant ("REGAL 330R", manufactured by Cabot Corporation) were blended together, mixed using an FM mixer, and then melt-kneaded using a two-axis extruder to give a melt-kneaded product. The melt-kneaded product was cooled, pulverized, and classified to give toner cores having a volume average diameter of 7 nm. The chargeability of the toner cores was measured using a standard carrier (N-01) to be −20 μC/g. The zeta-potential of the toner cores at pH 4 was −30 mV, showing that the toner cores were definitely anionic.

Next, a shell layer was formed on a surface of each toner core as follows. Specifically, 300 mL of ion exchanged water was adjusted to pH 4 with hydrochloric acid in a one-liter three-necked flask placed in a water bath at 30° C. Then, 2 mL of an aqueous solution of a prepolymer of methylolmelamine ("Mirben resin SM-607" having a solid concentration of 80% by mass, manufactured by Showa Denko K. K.) was added to and dissolved in the ion exchanged water. Then, 300 g of the toner cores were added to the aqueous solution and sufficiently stirred. Next, 500 mL of ion exchanged water was added, and the resulting aqueous solution was heated up to 70° C. at a rate of 2° C./minute under stirring and maintained at the same temperature for 2 hours. Thereafter, sodium hydroxide was added to the aqueous solution to adjust the pH of the aqueous solution to 7 to give toner mother particles.

Subsequently, washing was performed as follows. The solution containing the toner mother particles was filtered using a Buchner funnel to collect wet cake of the toner mother particles. The wet cake was dispersed in ion exchanged water again thereby to wash the toner mother particles. The same washing of the toner particles with ion exchanged water was repeated five times.

Then, drying was performed as follows. That is, the toner mother particles collected were left to stand in an atmosphere at 40° C. for 48 hours to be dried once the electrical conductivity of a dispersion of 2 g of the toner mother particles collected in 20 g of water fell below 10 μS/cm.

Subsequently, external additive addition was performed as follows. That is, as external additives, 1.0% by mass of titanium oxide fine particles ("EC-100", manufactured by Titan Kogyo, Ltd.) and 0.7% by mass of hydrophobic silica fine particles ("RA-200H", manufactured by Nippon Aerosil Co., Ltd.) were added with respect to the whole amount of the toner mother particles obtained as described above. Thereafter, the toner mother particles and the external additives were mixed using an FM mixer ("FM-10B", manufactured by Nippon Coke & Engineering Co., Ltd.) at a rotation speed of 3500 rpm for 5 minutes for the external additive addition to give the toner particles A.

(Preparation of Carrier A)

First, carrier core preparation was performed. Specifically, 40 parts by mass of manganese(II) oxide, 9 parts by mass of magnesium oxide, 50 parts by mass of iron(III) oxide, and 1 part by mass of strontium oxide were mixed and pulverized using a ball mill for 2 hours. Thereafter, the resulting pulverized product was baked at 1000° C. for 5 hours to give manganese ferrite carrier cores. The manganese ferrite carrier cores had a particle diameter of 40 nm and a saturation magnetization of 65 $Am^2/kg$ in response to application of a magnetic field at $3000\times10^3/4\pi\cdot A/m$.

Next, first layer formation liquid application was performed. A first layer formation liquid was prepared by dispersing 10 parts by mass of a tetrafluoroethylene-hexafluoropropylene copolymer (FEP) as a fluorine-based resin in 100 parts by mass of methyl ethyl ketone. The first layer formation liquid having a solid content of 5 parts by mass was applied to 100 parts by mass of the manganese ferrite carrier cores by spray coating using a flow coating apparatus.

Next, second layer formation liquid application was performed. A polyamide-imide resin-containing solution was used as a second layer formation liquid. The polyamide-imide resin-containing solution was obtained by diluting a polyamide-imide resin ("HPC-1000", manufactured by Hitachi Chemical Co., Ltd.) with ion exchanged water. The polyamide-imide resin-containing solution had a solid concentration (polyamide-imide resin concentration) of 10% by mass. The second layer formation liquid having a solid content of 5 parts by mass was applied to 100 parts by mass of the manganese ferrite carrier cores by spray coating while the carrier cores were being fluidized.

Thereafter, heat treatment was performed in a fluidization bath at 280° C. for 1 hour, and thus the fluorine-based resin and the polyamide-imide resin were cured to give the carrier A.

(Mixing)

The toner particles A and the carrier A were mixed together so that the proportion of the toner particles A was 10% by mass (i.e., so that the amount of the toner particles A added to 100 parts by mass of the toner particles A and the carrier A in total was 10 parts by mass). The mixture was mixed under stirring for 1 hour using a rocking mixer to give a two-component developer of Example 1.

Example 2

A two-component developer of Example 2 was obtained in the same manner as in Example 1 except that instead of the FEP, tetrafluoroethylene-perfluoroalkyl vinyl ether copolymer (PFA) was used as a fluorine-based resin contained in the first layer formation liquid.

Example 3

A two-component developer of Example 3 was obtained in the same manner as in Example 1 except that instead of the FEP, polytetrafluoroethylene (PTFE) was used as a fluorine-based resin contained in the first layer formation liquid.

Example 4

A two-component developer of Example 4 was obtained in the same manner as in Example 1 except that instead of the FEP, a mixed resin obtained by mixing tetrafluoroethylene-hexafluoropropylene copolymer (FEP (4-6 fluoride)) and polytetrafluoroethylene (PTFE) at a ratio (ratio by mass) of 1:1 was used as a fluorine-based resin contained in the first layer formation liquid.

Example 5

A two-component developer of Example 5 was obtained in the same manner as in Example 1 except that inorganic fine particle layer formation was performed after the first layer formation liquid application. That is, the two-component developer of Example 5 was obtained in the same manner as in Example 1 except that 3.0 parts by mass of magnetite fine particles ("RB-BL-P" having a volume average diameter of 0.1 μm, manufactured by Titan Kogyo, Ltd.) were added to 100 parts by mass of carrier cores subjected to the first layer formation liquid application while the carrier cores were being fluidized in a fluidization bath so that the magnetite fine particles were attached to the surface of each carrier core to form an inorganic fine particle layer, and subsequently the second layer formation liquid application was performed.

Example 6

A two-component developer of Example 6 was obtained in the same manner as in Example 5 except that instead of the FEP, tetrafluoroethylene-perfluoroalkyl vinyl ether copolymer (PFA) was used as a fluorine-based resin contained in the first layer formation liquid.

Example 7

A two-component developer of Example 7 was obtained in the same manner as in Example 5 except that instead of the FEP, polytetrafluoroethylene (PTFE) was used as a fluorine-based resin contained in the first layer formation liquid.

Example 8

A two-component developer of Example 8 was obtained in the same manner as in Example 5 except that instead of the FEP, a mixed resin obtained by mixing tetrafluoroethylene-hexafluoropropylene copolymer (FEP (4-6 fluoride)) and polytetrafluoroethylene (PTFE) at a ratio (ratio by mass) of 1:1 was used as a fluorine-based resin contained in the first layer formation liquid.

Example 9

A two-component developer of Example 9 was obtained in the same manner as in Example 8 except that the magnetite fine particles used in the inorganic fine particle layer formation were changed to magnetite fine particles "TN-15" (volume average diameter: 0.17 μm) manufactured by Mitsui Mining & Smelting Co., Ltd.

Example 10

A two-component developer of Example 10 was obtained in the same manner as in Example 8 except that the magnetite fine particles used in the inorganic fine particle layer formation were changed to titanium oxide fine particles ("JA-C" having a volume average diameter of 0.18 μm, manufactured by TAYCA CORPORATION).

Example 11

Preparation of Toner Particles B

First, toner cores were prepared in the same manner as in the toner particles A. Next, a shell layer was formed on a surface of each toner core. Specifically, 100 parts by mass of the toner cores, 1.0 part by mass of sodium acrylate ("JURYMER AC-103", manufactured by Toagosei Co., Ltd.) as a dispersant, 1 part by mass of a methylolated urea resin-containing solution ("Mirben resin SUM-100" having a solid concentration of 80% by mass, manufactured by Showa Denko K.K.) as a thermosetting resin, and 300 parts by mass of ion exchanged water adjusted to pH 4 with hydrochloric acid were stirred at a rotation speed of 1200 rpm to give a dispersion. Subsequently, the temperature of the dispersion was raised up to 70° C. at a heating rate of 0.4° C./minute under stirring and maintained at 70° C. for 1 hour. Thereafter, the dispersion was cooled to room temperature. Thus, the shell layer was formed so as to coat each toner core to give toner mother particles.

Next, washing, drying, and external additive addition were performed in the same manner as in the toner particles A to give the toner particles B.

(Preparation of Carrier B)

First, carrier core preparation and first layer formation liquid application were performed in the same manner as in the carrier A.

Next, second layer formation liquid application was performed in the same manner as in the carrier A except that a solution obtained by mixing 2 parts by mass of a melamine resin-containing solution (methylolated urea resin-containing solution ("Mirben resin SUM-100" having a solid concentration of 80% by mass, manufactured by Showa Denko K.K.)) and 300 parts by mass of ion exchanged water adjusted to pH 4 with hydrochloric acid was used as a second layer formation liquid.

Thereafter, heat treatment was performed in a fluidization bath at 280° C. for 1 hour, and thus the fluorine-based resin and the melamine resin were cured to give a carrier B.

(Mixing)

The toner particles B and the carrier B were mixed so that the proportion of the toner particles B was 10% by mass (i.e., so that the amount of the toner particles B added to 100 parts by mass of the toner particles B and the carrier B in total was 10 parts by mass). The mixture was mixed under stirring for 1 hour using a rocking mixer to give a two-component developer of Example 11.

Example 12

A two-component developer of Example 12 was obtained in the same manner as in Example 11 except that instead of the FEP, tetrafluoroethylene-perfluoroalkyl vinyl ether copolymer (PFA) was used as a fluorine-based resin contained in the first layer formation liquid.

Example 13

A two-component developer of Example 13 was obtained in the same manner as in Example 11 except that instead of the FEP, polytetrafluoroethylene (PTFE) was used as a fluorine-based resin contained in the first layer formation liquid.

Example 14

A two-component developer of Example 14 was obtained in the same manner as in Example 11 except that instead of the FEP, a mixed resin obtained by mixing tetrafluoroethylene-hexafluoropropylene copolymer (FEP (4-6 fluoride)) and polytetrafluoroethylene (PTFE) at a ratio (ratio by mass) of 1:1 was used as a fluorine-based resin contained in the first layer formation liquid.

Example 15

A two-component developer of Example 15 was obtained in the same manner as in Example 11 except that inorganic fine particle layer formation was performed after the first layer formation liquid application. That is, the two-component developer of Example 15 was obtained in the same manner as in Example 11 except that 3.0 parts by mass of magnetite fine particles ("RB-BL-P" having a volume average diameter of 0.1 μm, manufactured by Titan Kogyo, Ltd.) were added to 100 parts by mass of carrier cores subjected to the first layer formation liquid application while the carrier cores were being fluidized in a fluidization bath so that the magnetite fine particles were attached to the surface of the first layer formation liquid applied to form an inorganic fine particle layer, and subsequently the second layer formation liquid application was performed.

Example 16

A two-component developer of Example 16 was obtained in the same manner as in Example 15 except that instead of the FEP, tetrafluoroethylene-perfluoroalkyl vinyl ether copolymer (PFA) was used as a fluorine-based resin contained in the first layer formation liquid.

Example 17

A two-component developer of Example 17 was obtained in the same manner as in Example 15 except that instead of the FEP, polytetrafluoroethylene (PTFE) was used as a fluorine-based resin contained in the first layer formation liquid.

Example 18

A two-component developer of Example 18 was obtained in the same manner as in Example 15 except that instead of the FEP, a mixed resin obtained by mixing tetrafluoroethylene-hexafluoropropylene copolymer (FEP (4-6 fluoride)) and polytetrafluoroethylene (PTFE) at a ratio (ratio by mass) of 1:1 was used as a fluorine-based resin contained in the first layer formation liquid.

Example 19

A two-component developer of Example 19 was obtained in the same manner as in Example 18 except that the magnetite fine particles used in the inorganic fine particle layer formation were changed to magnetite fine particles "TN-15" (volume average diameter: 0.17 μm) manufactured by Mitsui Mining & Smelting Co., Ltd.

Example 20

A two-component developer of Example 20 was obtained in the same manner as in Example 18 except that the magnetite fine particles used in the inorganic fine particle layer formation were changed to titanium oxide fine particles ("JA-C" having a volume average diameter of 0.18 μm, manufactured by TAYCA CORPORATION).

Comparative Example 1

A two-component developer of Comparative Example 1 was obtained in the same manner as in Example 1 except that toner cores that were not subjected to the shell layer formation and therefore had no shell layer were used as toner particles.

Comparative Example 2

A two-component developer of Comparative Example 2 was obtained in the same manner as in Example 1 except that for preparing the carrier A, only a first layer (a layer containing a fluorine-based resin) was formed on the surface of each carrier core, and no second layer for coating the surface of the first layer was formed.

Comparative Example 3

A two-component developer of Comparative Example 3 was obtained in the same manner as in Example 1 except that for preparing the carrier A, only a second layer (a layer containing a polyamide-imide resin) was formed on the surface of each carrier core, and no first layer was formed.

Comparative Example 4

A two-component developer of Comparative Example 4 was obtained in the same manner as in Example 1 except that a resin-containing solution obtained by mixing and dispersing tetrafluoroethylene-hexafluoropropylene copolymer (FEP) and a polyamide-imide resin was applied to the surface of each carrier core to form only a layer containing the fluorine-based resin and the polyamide-imide resin, that is, except that a coat layer containing a mixed resin of the fluorine-based resin and the polyamide-imide resin was formed in the carrier A instead of the two-layer structure of the first and second layers stacked one on top of the other. The resin-containing solution used in Comparative Example 4 was obtained by mixing a solution of 5 parts by weight of a resin FEP in 100 parts by mass of ion exchanged water with 5 parts by mass of the polyamide-imide resin-containing solution prepared in the second layer formation liquid application in Example 1.

Comparative Example 5

A two-component developer of Comparative Example 5 was obtained in the same manner as in Example 5 except that the second layer formation liquid used in Example 1 was applied to the carrier cores, and then the first layer formation liquid used in Example 1 was applied to the inorganic fine particle layer, that is, the stacking order of the first and second layers in Example 5 was reversed.

Comparative Example 6

A two-component developer of Comparative Example 6 was obtained in the same manner as in Example 5 except that a silicone resin ("SR2410", manufactured by Dow Corning Toray Co., Ltd.) was used instead of the polyamide-imide resin in the second layer formation liquid.

Comparative Example 7

A two-component developer of Comparative Example 7 was obtained in the same manner as in Example 11 except that toner cores that were not subjected to the shell layer formation and therefore had no shell layer were used as toner particles.

Comparative Example 8

A two-component developer of Comparative Example 8 was obtained in the same manner as in Example 11 except that only a first layer (a layer containing a fluorine-based resin) was formed on the surface of the carrier B, and no second layer for coating the surface of the first layer was formed.

Comparative Example 9

A two-component developer of Comparative Example 9 was obtained in the same manner as in Example 11 except that only a second layer (a layer containing a melamine resin) was formed on the surface of the carrier B, and no first layer was formed.

Comparative Example 10

A two-component developer of Comparative Example 10 was obtained in the same manner as in Example 11 except that a resin-containing solution obtained by mixing and dispersing tetrafluoroethylene-hexafluoropropylene copolymer (FEP) and a melamine resin was applied to carrier cores to form only a layer containing the fluorine-based resin and the melamine resin, that is, except that a coat layer containing a mixed resin of the fluorine-based resin and the melamine resin was formed on the surface of the carrier B instead of the two-layer structure of the first and second layers stacked one on top of the other. The resin-containing solution used in Comparative Example 10 was prepared by mixing 5 parts by mass of the FEP and 5 parts by mass of the melamine resin with respect to 100 parts by mass of ion exchanged water.

Comparative Example 11

A two-component developer of Comparative Example 11 was obtained in the same manner as in Example 15 except that the second layer formation liquid used in Example 11 was applied to the carrier cores, and then the first layer formation liquid used in Example 11 was applied to the inorganic fine particle layer, that is, the stacking order of the first and second layers in Example 15 was reversed.

Comparative Example 12

A two-component developer of Comparative Example 12 was obtained in the same manner as in Example 15 except that a urea resin ("Mirben resin 3HSP-H", manufactured by Showa Denko K.K.) was used instead of the melamine resin in the second layer formation liquid.

Comparative Example 13

A two-component developer of Comparative Example 13 was obtained in the same manner as in Example 15 except that a silicone resin ("SR2410", manufactured by Dow Corning Toray Co., Ltd.) was used instead of the melamine resin in the second layer formation liquid.

The two-component developers obtained in the examples and the comparative examples were evaluated as follows.

(1) Image Density (ID)

An image sample A for initial-stage evaluation was printed with replenishment toner particles and each of the two-component developers obtained in the examples and the comparative examples in a normal environment (temperature: 20° C., relative humidity: 50%) using a multifunction peripheral ("Taskalfa 500ci", manufactured by KYOCERA Document Solutions Inc.) Thereafter, continuous printing on 10000 sheets was performed at a coverage rate of 1.0%. Then, an image sample (image sample B) after the 10000-sheet continuous printing was printed out. Thereafter, continuous printing on 100000 sheets was performed at a coverage rate of 5.0%. Then, an image sample (image sample C) after the 100000-sheet continuous printing was printed out. Each image sample includes a 5 cm square solid image and a non-printing area. The image density (ID) of the solid images in the image samples A, B, and C was measured using a Macbeth reflectance densitometer ("RD914", manufactured by SAKATA INX ENG. CO., LTD.) The image density was measured at five points in each image, and an average of measurement values obtained was determined as the image density of the image. The image density was evaluated according to the following criteria.

Very good (VG): The ID was 1.3 or higher. In this case, the image density is particularly high, and the image quality is very good.

Good (G): The ID was 1.0 or higher and lower than 1.3. In this case, the image density is high, and the image quality is good.

Poor (P): The ID was lower than 1.0. In this case, the image density is very low, and the image quality is poor.

(2) Fogging Density (FD)

The fogging density (FD) of the non-printing areas of the image samples A, B, and C obtained in the above-described image density evaluation was measured using a reflectance densitometer ("R710", manufactured by Ihara Electronic Industries Co., Ltd.) The FD was calculated according to the following equation. The fogging density was measured at five points in each image, and an average of measurement values obtained was determined as the fogging density of the image.

FD="reflection density in blank paper portion of paper subjected to printing"−"reflection density of paper not subjected to printing"

The fogging density was evaluated according to the following criteria.

Very good (VG): The FD was 0.005 or lower. In this case, the FD is particularly low, and the image quality is very good.

Good (G): The FD was higher than 0.005 and 0.010 or lower. In this case, the FD is low, and the image quality is good.

Poor (P): The FD was higher than 0.010. In this case, the FD is very high, and the image quality is poor.

(3) Evaluation of Reduction of Toner Spent

Whether or not the toner was spent on the carrier was determined for the two-component developers obtained in the examples and the comparative examples. The toner was removed from each two-component developer subjected to the printing as described in (1) or (2) above by suction through a 795-mesh screen to extract the carrier subjected to the printing. The amount of carbon in the carrier subjected to the printing and the initial-stage carrier was measured using a total carbon analyzer ("EMIA-110", manufactured by HORIBA, Ltd.), and the rate of toner spent was calculated according to the following equation.

Rate of toner spent (%)=[("amount of carbon on carrier subjected to printing"−"amount of carbon on initial-stage carrier")/"amount of carbon on initial-stage carrier"]×100

The rate of toner spent was evaluated according to the following criteria.

Good (G): The rate of toner spent was lower than 20%.

Poor (P): The rate of toner spent was 20% or higher.

Table 1 collectively shows evaluation results of the two-component developers obtained in the examples and the comparative examples.

TABLE 1

| | Two-component developer | | | | | Evaluation | | | | | | | | | | | |
|---|---|---|---|---|---|---|---|---|---|---|---|---|---|---|---|---|---|
| | | | Structure of carrier | | | Image density | | | | | | Fogging | | | | | |
| | | | | | | Initial stage | | 10000-sheet printing at coverage rate of 1.0% | | 100000-sheet printing at courage rate of 5.0% | | Initial stage | | 10000-sheet printing at coverage rate of 1.0% | | 100000-sheet printing at coverage rate of 5.0% | | Reduction of toner spent | |
| | Structure of toner particle | Toner particles | Resin in first layer | Resin in second layer | Inorganic fine particles in inorganic fine particle layer | ID | Evaluation | ID | Evaluation | ID | Evaluation | FD | Evaluation | FD | Evaluation | FD | Evaluation | Rate of toner spent (%) | Evaluation |
| Example 1 | Toner core + Shell layer | A | FEP | Polyamide-imide | — | 1.33 | VG | 1.22 | G | 1.28 | G | 0.003 | VG | 0.007 | G | 0.006 | G | 14 | G |
| Example 2 | Toner core + Shell layer | A | PFA | Polyamide-imide | — | 1.40 | VG | 1.28 | G | 1.27 | G | 0.003 | VG | 0.008 | G | 0.007 | G | 13 | G |
| Example 3 | Toner core + Shell layer | A | PTFE | Polyamide-imide | — | 1.37 | VG | 1.21 | G | 1.24 | G | 0.004 | VG | 0.008 | G | 0.009 | G | 11 | G |
| Example 4 | Toner core + Shell layer | A | FEP/PTFE | Polyamide-imide | — | 1.32 | VG | 1.19 | G | 1.26 | G | 0.005 | VG | 0.009 | G | 0.009 | G | 13 | G |
| Example 5 | Toner core + Shell layer | A | FEP | Polyamide-imide | Magnetite | 1.42 | VG | 1.34 | VG | 1.26 | G | 0.003 | VG | 0.003 | VG | 0.006 | G | 8 | G |
| Example 6 | Toner core + Shell layer | A | PFA | Polyamide-imide | Magnetite | 1.38 | VG | 1.32 | VG | 1.28 | G | 0.002 | VG | 0.003 | VG | 0.007 | G | 9 | G |
| Example 7 | Toner core + Shell layer | A | PTFE | Polyamide-imide | Magnetite | 1.36 | VG | 1.33 | VG | 1.20 | G | 0.004 | VG | 0.004 | VG | 0.008 | G | 7 | G |
| Example 8 | Toner core + Shell layer | A | FEP/PTFE | Polyamide-imide | Magnetite | 1.41 | VG | 1.36 | VG | 1.25 | G | 0.004 | VG | 0.005 | VG | 0.010 | G | 8 | G |
| Example 9 | Toner core + Shell layer | A | FEP | Polyamide-imide | Magnetite | 1.39 | VG | 1.35 | VG | 1.21 | G | 0.003 | VG | 0.004 | VG | 0.008 | G | 9 | G |
| Example 10 | Toner core + Shell layer | A | FEP | Polyamide-imide | Titanium oxide | 1.34 | VG | 1.17 | G | 1.23 | G | 0.003 | VG | 0.003 | VG | 0.007 | G | 10 | G |
| Example 11 | Toner core + Shell layer | B | FEP | Melamine | — | 1.38 | VG | 1.22 | G | 1.25 | G | 0.002 | VG | 0.008 | G | 0.007 | G | 12 | G |
| Example 12 | Toner core + Shell layer | B | PFA | Melamine | — | 1.40 | VG | 1.26 | G | 1.28 | G | 0.001 | VG | 0.007 | G | 0.007 | G | 14 | G |
| Example 13 | Toner core + Shell layer | B | PTFE | Melamine | — | 1.39 | VG | 1.23 | G | 1.25 | G | 0.002 | VG | 0.007 | G | 0.008 | G | 11 | G |
| Example 14 | Toner core + Shell layer | B | FEP/PTFE | Melamine | — | 1.38 | VG | 1.20 | G | 1.26 | G | 0.003 | VG | 0.009 | G | 0.007 | G | 12 | G |
| Example 15 | Toner core + Shell layer | B | FEP | Melamine | Magnetite | 1.42 | VG | 1.35 | VG | 1.29 | G | 0.003 | VG | 0.003 | VG | 0.006 | G | 7 | G |
| Example 16 | Toner core + Shell layer | B | PFA | Melamine | Magnetite | 1.44 | VG | 1.32 | VG | 1.28 | G | 0.002 | VG | 0.004 | VG | 0.007 | G | 9 | G |
| Example 17 | Toner core + Shell layer | B | PTFE | Melamine | Magnetite | 1.41 | VG | 1.33 | VG | 1.27 | G | 0.001 | VG | 0.003 | VG | 0.006 | G | 7 | G |
| Example 18 | Toner core + Shell layer | B | FEP/PTFE | Melamine | Magnetite | 1.42 | VG | 1.36 | VG | 1.28 | G | 0.002 | VG | 0.005 | VG | 0.007 | G | 8 | G |
| Example 19 | Toner core + Shell layer | B | FEP/PTFE | Melamine | Magnetite | 1.43 | VG | 1.34 | VG | 1.29 | G | 0.003 | VG | 0.004 | VG | 0.006 | G | 8 | G |
| Example 20 | Toner core + Shell layer | B | FEP/PTFE | Melamine | Titanium oxide | 1.37 | VG | 1.20 | G | 1.22 | G | 0.002 | VG | 0.004 | VG | 0.008 | G | 9 | G |
| Comparative Example 1 | Only toner core | — | FEP | Polyamide-imide | Magnetite | 1.36 | VG | 1.21 | G | 1.28 | G | 0.008 | G | 0.007 | G | 0.014 | P | 34 | P |
| Comparative Example 2 | Toner core + Shell layer | A | FEP*1 | | — | 0.95 | P | 0.83 | P | 0.90 | P | 0.001 | VG | 0.002 | VG | 0.002 | VG | 29 | P |
| Comparative Example 3 | Toner core + Shell layer | A | Polyamide-imide*2 | | — | 0.84 | P | Unevaluable | | | | 0.015 | P | Unevaluable | | | | | |

TABLE 1-continued

| | Two-component developer | | | | | Evaluation | | | | | | | | | | | |
|---|---|---|---|---|---|---|---|---|---|---|---|---|---|---|---|---|---|
| | | | Structure of carrier | | | Image density | | | | | | Fogging | | | | | |
| | Structure of toner particle | Toner particles | Resin in first layer | Resin in second layer | Inorganic fine particles in inorganic fine particle layer | Initial stage ID | Evaluation | 10000-sheet printing at coverage rate of 1.0% ID | Evaluation | 100000-sheet printing at courage rate of 5.0% ID | Evaluation | Initial stage FD | Evaluation | 10000-sheet printing at coverage rate of 1.0% FD | Evaluation | 100000-sheet printing at coverage rate of 5.0% FD | Evaluation | Reduction of toner spent: Rate of toner spent (%) | Evaluation |
| Comparative Example 4 | Toner core + Shell layer | A | FEP/Polyamide-imide*3 | | — | 1.13 | G | 0.98 | P | 1.09 | G | 0.010 | G | 0.017 | P | 0.018 | P | 22 | P |
| Comparative Example 5 | Toner core + Shell layer | A | Polyamide-imide | FEP | — | 0.92 | P | 0.85 | P | 0.90 | P | 0.003 | VG | 0.003 | VG | 0.006 | G | 25 | P |
| Comparative Example 6 | Toner core + Shell layer | A | FEP | Silicone | — | 0.97 | P | 0.88 | P | 0.92 | P | 0.004 | VG | 0.003 | VG | 0.007 | G | 11 | G |
| Comparative Example 7 | Only toner core | — | FEP | Melamine | — | 1.35 | VG | 1.22 | G | 1.26 | G | 0.003 | VG | 0.008 | G | 0.012 | P | 35 | P |
| Comparative Example 8 | Toner core + Shell layer | B | FEP*1 | | — | 0.96 | P | 0.82 | P | 0.91 | P | 0.002 | VG | 0.004 | VG | 0.003 | VG | 28 | P |
| Comparative Example 9 | Toner core + Shell layer | B | Melamine*2 | | — | 0.86 | P | Unevaluable | | | | 0.015 | P | Unevaluable | | | | | |
| Comparative Example 10 | Toner core + Shell layer | B | FEP/Melamine*3 | | — | 1.14 | G | 0.98 | P | 1.10 | G | 0.011 | G | 0.013 | P | 0.016 | P | 22 | P |
| Comparative Example 11 | Toner core + Shell layer | B | Melamine | FEP | Magnetite | 0.94 | P | 0.81 | P | 0.92 | P | 0.003 | VG | 0.004 | VG | 0.007 | G | 27 | P |
| Comparative Example 12 | Toner core + Shell layer | B | FEP | Urea | Magnetite | 1.38 | VG | 1.22 | G | 1.28 | G | 0.002 | VG | 0.005 | G | 0.011 | P | 21 | P |
| Comparative Example 13 | Toner core + Shell layer | B | FEP | Silicone | Magnetite | 0.96 | P | 0.86 | P | 0.91 | P | 0.002 | VG | 0.004 | VG | 0.008 | G | 15 | G |

The symbol "–" in Table 1 indicates that no inorganic fine particle layer was formed. The symbol "*1" indicates that only the first layer was formed and no second layer was formed in the carrier A or B. The symbol "*2" indicates that only the second layer was formed and no first layer was formed in the carrier A or B. The symbol "*3" indicates that a coat layer containing a fluorine-based resin and a polyamide-imide resin was formed instead of the two-layer structure of the first and second layers.

In the carriers in the two-component developers obtained in Examples 1 to 4 and 11 to 14, as obvious from Table 1, no inorganic fine particle layer containing magnetite fine particles was formed between the first layer and the second layer. That is, these carriers included the first layer coating the surface of each carrier core and the second layer coating the entire surface of the first layer. Accordingly, the chargeability of the toner particles was stable, the density of the images formed did not fall below a desired density, and fogging was reduced even in the continuous printing at varied coverage rates. Furthermore, the amount of toner spent on the carriers was held low, and the carriers had excellent durability.

In the carriers in the two-component developers obtained in Examples 5 to 9 and 15 to 18, the inorganic fine particle layer containing magnetite fine particles was formed between the first layer and the second layer. Accordingly, the second layer was more uniform, and less fogging was observed after the continuous printing at a coverage rate of 1.0% in Examples 5 to 9 and 15 to 18 than in Examples 1 to 4 and 11 to 14 where no inorganic fine particle layer was formed in the carriers. Furthermore, the high electrical conductivity of the magnetite fine particles prevented excessive charging of toner particles, and thus the density of the images formed after the continuous printing at a coverage rate of 1.0% was prevented from falling below a desired density. In the carrier contained in the two-component developer obtained in Example 19, the inorganic fine particle layer containing the magnetite fine particles was formed between the first layer and the second layer. However, in this case, the inorganic fine particles attached to the first layer had a too large particle diameter, and therefore it is supposed that a considerable amount of inorganic fine particles shed from the first layer during the production of the carrier. Accordingly, the image density and the fogging reducing effect in this case were not much higher or better than those in the case of the two-component developers of Examples 1 to 4 and 11 to 14 containing the carriers having no inorganic fine particle layer.

In the carriers in the two-component developers obtained in Examples 10 and 20, the inorganic fine particle layer containing titanium oxide fine particles was formed between the first layer and the second layer. Accordingly, the second layer was more uniform, and less fogging was observed after the continuous printing at a coverage rate of 1.0% in Examples 10 and 20 than in Examples 1 to 4 and 11 to 14 where no inorganic fine particle layer was formed in the carriers. However, in these cases, the image density after the continuous printing at a coverage rate of 1.0% was not much higher than that in the cases of the two-component developers obtained in Examples 1 to 4 and 11 to 14 where no inorganic fine particle layer was formed in the carriers because the titanium oxide fine particles had a lower electrical conductivity than the magnetite fine particles.

In the two-component developers obtained in Comparative Examples 1 and 7 containing toner particles having toner cores with no shell layer, toner spent on the carriers was observed. Furthermore, the chargeability of the toner particles decreased, and therefore fogging was observed after the continuous printing at a coverage rate of 5.0%.

In the carriers contained in the two-component developers obtained in Comparative Examples 2 and 8, no second layer was formed. Accordingly, the chargeability was too high, and therefore the image density was low from the initial-stage printing. In addition, toner was spent on the carriers. Furthermore, the durability of the carriers was poor.

In the carriers contained in the two-component developers obtained in Comparative Examples 3 and 9, no first layer was formed. Accordingly, the chargeability was extremely low, and the image density was low from the initial-stage printing. In addition, fogging was observed. Furthermore, toner particles scattered within the developing device during the continuous printing, preventing the evaluation from being continued.

In the carrier contained in the two-component developer obtained in Comparative Example 4, a coat layer containing a mixed resin of a fluorine-based resin and a polyamide-imide resin was formed. Accordingly, the coat layer was non-uniform, and the chargeability was unstable. As a result, the image density after the continuous printing at a coverage rate of 1.0% was reduced. Furthermore, fogging was observed after the continuous printing at a coverage rate of 1.0%. This is considered because the toner charging ability of the carrier of Comparative Example 4 was low. In addition, the fluorine-based resin partly emerged on the surface of the carrier, and therefore toner was spent on the carrier. Furthermore, the durability of the carrier was poor.

In the carriers contained in the two-component developers obtained in Comparative Examples 5 and 11, the stacking order of the first layer and the second layer was reversed. Accordingly, the chargeability was too high even when the inorganic fine particle layer was formed in the carrier, and the image density was low from the initial-stage printing. In addition, the fluorine-based resin emerged on the surfaces of the carriers, and therefore toner was spent on the carriers. Furthermore, the durability of the carriers was poor.

In the carrier contained in the two-component developer obtained in Comparative Example 6, a silicone resin was used as a resin forming the second layer instead of a polyamide-imide resin and/or a melamine resin. Accordingly, the chargeability was too high, and therefore the image density was low from the initial-stage printing. Furthermore, the durability of the carrier was poor.

In the carrier contained in the two-component developer obtained in Comparative Example 10, a coat layer containing a mixed resin of a fluorine-based resin and a melamine resin was formed. Accordingly, the coat layer was non-uniform, and the chargeability was unstable. As a result, the image density after the continuous printing at a coverage rate of 1.0% was reduced. In addition, fogging was observed after the printing at a coverage rate of 1.0%. Furthermore, toner was spent on the carrier because of the fluorine-based resin emerging on the surface of the carrier.

In the carrier contained in the two-component developer obtained in Comparative Example 12, a urea resin was used as a resin forming the second layer instead of a polyamide-imide resin and/or a melamine resin, and therefore the chargeability was low. As a result, fogging was observed after the continuous printing at a coverage rate of 5.0%. In addition, toner was spent on the carrier.

In the carrier contained in the two-component developer obtained in Comparative Example 13, a silicone resin was used as a resin forming the second layer instead of a polyamide-imide resin and/or a melamine resin. Accordingly, the chargeability was too high, and therefore the image density was low from the initial-stage printing. Furthermore, the durability of the carrier was poor.

What is claimed is:

1. A two-component developer containing a carrier and toner particles, the carrier including a carrier core, a first layer coating a surface of the carrier core, and a second layer coating a surface of the first layer, the first layer containing a fluorine-based resin, the second layer containing a polyamide-imide resin and/or a melamine resin, the toner particles each including a toner core containing a binder resin and a shell layer coating a surface of the toner core, the shell layer containing a thermosetting resin.

2. A two-component developer according to claim 1, wherein the fluorine-based resin is one or more resins selected from tetrafluoroethylene-perfluoroalkylvinylether copolymer, tetrafluoroethylene-hexafluoropropylene copolymer, and polytetrafluoroethylene.

3. A two-component developer according to claim 1, wherein an inorganic fine particle layer containing inorganic fine particles is formed between the first layer and the second layer.

4. A two-component developer according to claim 3 wherein the inorganic fine particles are magnetite fine particles.

5. A method for producing a two-component developer containing a carrier and toner particles, comprising:

preparing the carrier;

preparing the toner particles; and mixing the carrier and the toner particles, wherein the toner particles each include a toner core containing a binder resin and a shell layer coating a surface of the toner core, the shell layer containing a thermosetting resin, and the preparing the carrier includes:

preparing carrier cores;

applying a first layer formation liquid containing a fluorine-based resin to surfaces of the carrier cores;

applying a second layer formation liquid containing a polyamide-imide resin and/or a melamine resin to the surfaces of the carrier cores subjected to the applying of the first layer formation liquid; and heat-treating the carrier cores subjected to the applying of the first layer formation liquid and the second layer formation liquid.

* * * * *